United States Patent [19]

Kunitake et al.

[11] Patent Number: 5,010,835

[45] Date of Patent: Apr. 30, 1991

[54] SEMI-SUBMERGED GLASS BOAT

[75] Inventors: Yoshikuni Kunitake, Nagareyama; Yasuhiro Harita, Funabashi, both of Japan

[73] Assignee: Mitsui Engineering & Shipbuilding Co., Ltd., Tokyo, Japan

[21] Appl. No.: 443,631

[22] Filed: Nov. 30, 1989

[30] Foreign Application Priority Data

| | | | |
|---|---|---|---|
| Dec. 2, 1988 | [JP] | Japan | 63-156578[U] |
| Dec. 2, 1988 | [JP] | Japan | 63-156579 |
| Feb. 2, 1989 | [JP] | Japan | 1-10805 |
| Mar. 10, 1989 | [JP] | Japan | 1-26665[U] |

[51] Int. Cl.[5] ..... B63B 35/72

[52] U.S. Cl. ..... 114/66; 114/126; 114/219

[58] Field of Search ..... 114/66, 126, 219, 56

[56] References Cited

U.S. PATENT DOCUMENTS

| | | | |
|---|---|---|---|
| 4,423,695 | 1/1984 | Rougerie | 114/66 X |
| 4,494,472 | 1/1985 | Rougerie | 114/66 |

FOREIGN PATENT DOCUMENTS

| | | | |
|---|---|---|---|
| 31407/84 | 2/1985 | Australia . | |
| 214092 | 9/1987 | Japan | 114/66 |
| 47169 | 11/1989 | Norway | 114/126 |

*Primary Examiner*—Sherman D. Basinger

*Attorney, Agent, or Firm*—Armstrong, Nikaido, Marmelstein, Kubovcik & Murray

[57] ABSTRACT

An improvement is made in terms of rolling of a semi-submerged glass boat whose hull is formed of the main hull and float tanks provided on the lateral sides of the upper part of the main hull, and anti-rolling fins each projecting outside of a straight line connecting the outer end part of the bottom of the float tank and the outer end part of the bottom of the main hull are provided on the opposite sides of the main hull respectively.

5 Claims, 5 Drawing Sheets

SEMI-SUBMERGED GLASS BOAT

BACKGROUND OF THE INVENTION

The present invention relates to a semi-submerged glass boat obtained by improving the comfortableness on board a semi-submerged glass boat which is equipped with float tanks on the opposite sides of the upper part of the main hull.

The semi-submerged glass boat which is equipped with the float tanks on the opposite sides of the upper part of the main hull from a viewpoint of safety has been seen heretofore. This semi-submerged glass boat, however, is susceptible to the effect of waves, since the float tanks bulge out from both sides of the main hull and, besides, the draft of the float tanks is shallow.

Accordingly, even small waves cause rolling, bringing about uncomfortableness on board. Since the bottom surface of the float tank is flat, in addition, a shock due to the waves is large, which tends to cause a feeding of discomfort.

SUMMARY OF THE INVENTION

In view of these conventional problems, the present invention aims at furnishing a semi-submerged glass boat which is less subjected to rolling and shock due to waves.

Regarding a semi-submerged glass boat whose hull is formed of the main hull and float tanks provided on the opposite sides of the upper part of the main hull and which has observation windows on the lateral sides of the lower part of the main hull, the semi-submerged glass boat of the present invention is characterized in that anti-rolling fins each projecting outside of a straight line connecting the outer end part of the bottom part of the float tank and the outer end part of the bottom part of the main hull are provided on the opposite sides of the hull.

Generally, the center of rolling of the hull is located in the vicinity of the center of gravity G thereof. Besides, the center of a hill of the hull is located at the center of floatation (the point of intersection of a draft line and the center line of the hull) F.

In order to make the anti-rolling fins function sufficiently, accordingly, it is preferable that the anti-rolling fins are installed so that a point B of intersection of extensions of the fins and the center line of the hull is positioned at the center of gravity G of the hull or between the center of floatation F and the center of gravity G of the hull. In addition, it is preferable that the anti-rolling fins are positioned underwater as near a water surface as possible.

The aforesaid anti-rolling fins are allowed to be provided with a plurality of openings.

In order to mitigate the shock due to waves, on the other side, it is preferable that the cross section of the bottom part of each float tank is formed in the shape of V substantially. An angle $\theta$ of inclination of the outer side thereof is set to be 5° to 30°, or more preferably 15° to 25°.

From a viewpoint of safety, in addition, it is important that the float tanks have buoyancy large enough to keep the depth of water from the top of the floor of a passage of a submerged cabin to the water surface in the damage condition at about 1.5 m when seawater breaks into the submerged cabin in the main hull from the observation windows, for instance. Besides, the cleave height of the submerged cabin between the floor and ceiling should be enough high for the standing passenger.

Moreover, it is desirable that a bumper is provided along the main hull on the lateral side thereof so as to prevent the main hull and the observation windows from being damaged. It is desirable that the edge part of this bumper projects outside of the observation windows with a view to protecting the main hull and observation windows, in particular.

DESCRIPTION OF THE PREFERRED EMBODIMENTS

The semi-submerged glass boat of the present invention will be described hereunder on the basis of the drawings.

Figure 1:
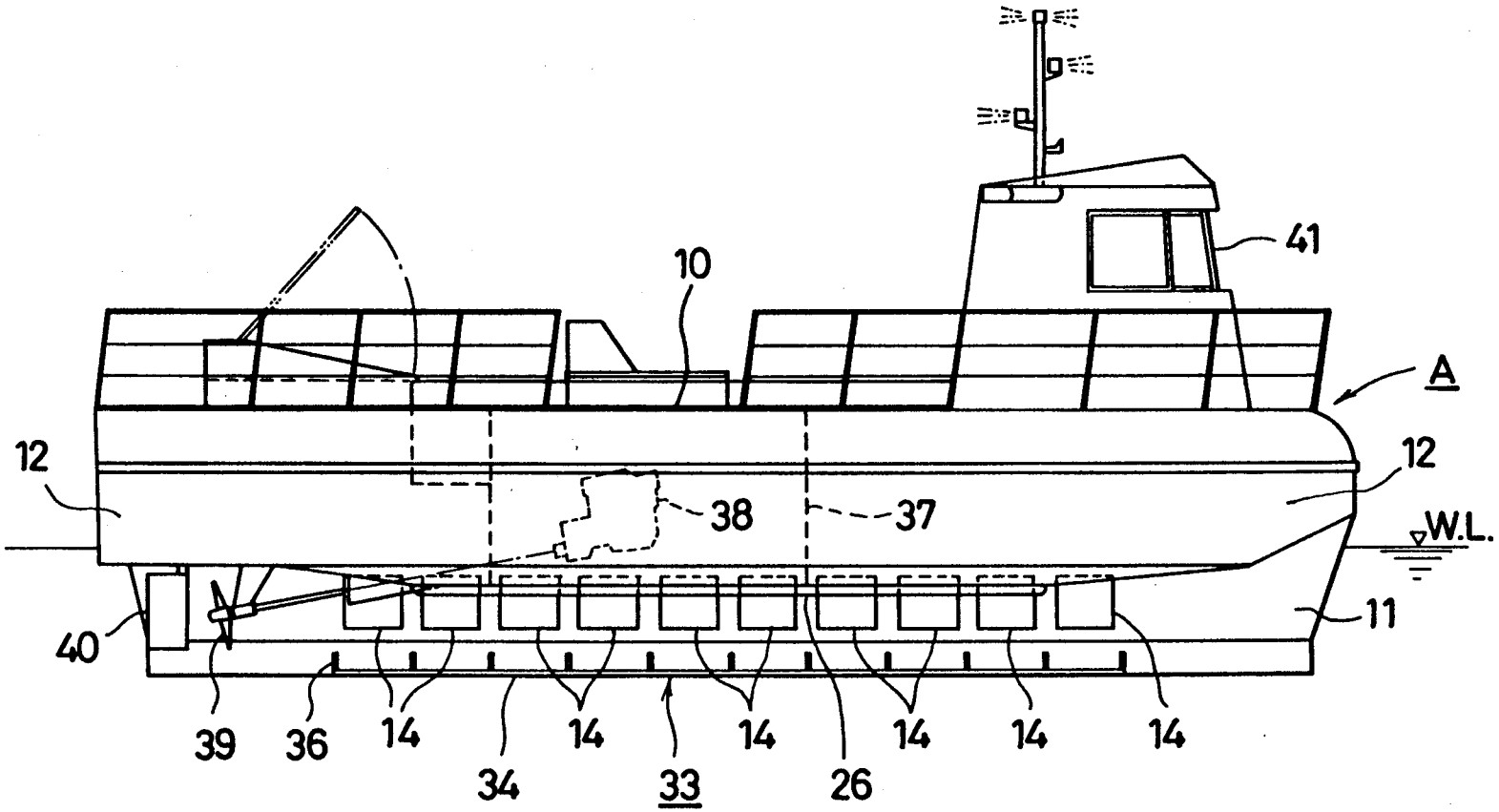
FIG. 1 is a side view of a semi-submerged glass boat of the present invention.
Figure 2:
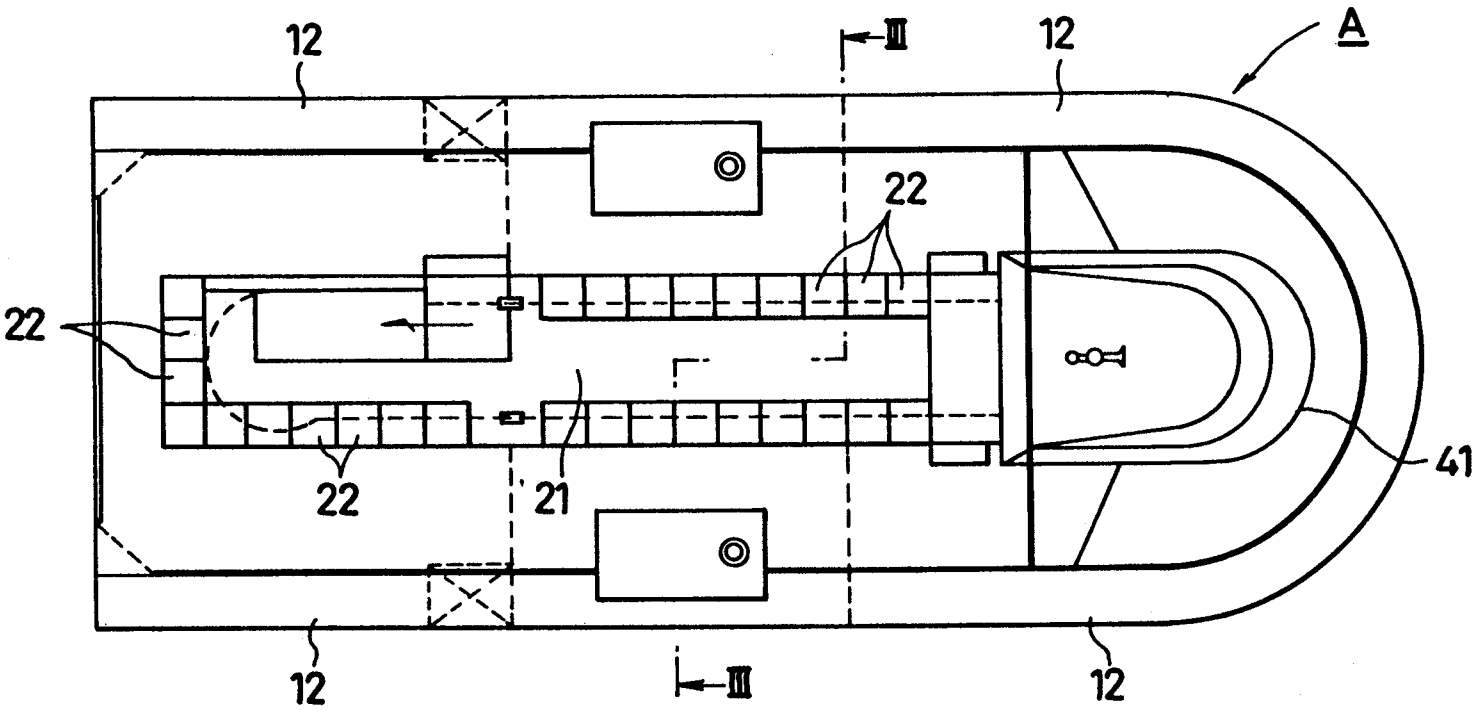
FIG. 2 is a plan view of the semi-submerged glass boat of the present invention.
Figure 3:
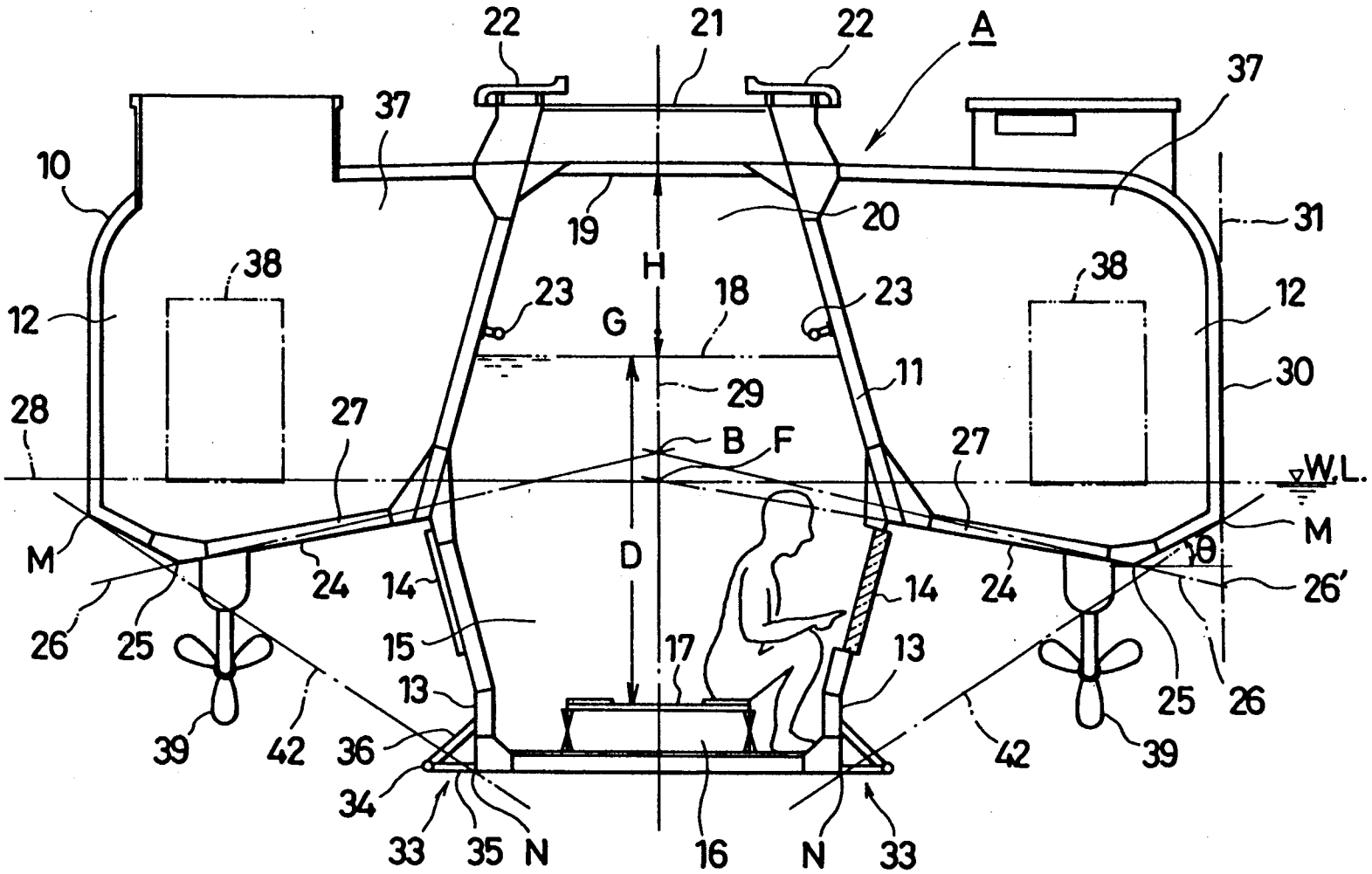
FIG. 3 is a section taken along a line III—III of FIG. 2.

In FIG. 1, mark A denotes a semi-submerged glass boat, in the bow part of which a cabin 41 is installed. The hull 10 of this semi-submerged glass boat is formed principally of the main hull 11 and float tanks 12 provided on the lateral sides of the upper part of this main hull 11, as shown in FIG. 3. Besides, observation windows 14 are provided on the lower lateral sides of the main hull 11 positioned below the float tanks 12, respectively.

The aforesaid float tanks 12 have sufficiently large buoyancy, and they are so formed that even when seawater breaks into a submerged cabin of the main hull 11 from any damaged observation window 14, for instance, the depth D of water from the top 17 of the floor of a passage 16 to a water surface 18 in the damage condition is kept at about 1.5 m. When standing up on the floor of the passage 16, accordingly, a man of mean stature can keep his head for breathing above the water surface 18 in the damage condition. Besides, the height H of a space 20 from the water surface 18 in the damage condition to the ceiling 19 of the submerged cabin 15 is secured to be about 0.8 m so that the head may not be barred by the ceiling 19 of submerged cabin 15 when the man stands up on the floor of the passage 16. On both right and left sides of the submerged cabin 15, handrails 23 are fitted slightly above the aforesaid water surface 18 respectively. As shown in FIG. 3, in addition, the upper side of the main hull 11 is formed to be a deck 21, and benches 22 are installed in the periphery thereof.

As shown in FIG. 3 as well, the cross section of the bottom 24 of the float tank 12 is formed in the shape of V substantially so as to reduce a shock due to waves. In order to decrease the rolling of the hull 10, in addition, an anti-rolling fin 26 is fitted to the top part 25 of the V-shaped bottom 24 of the float tank 12 so that it projects downward obliquely from said top part 25.

More concretely, the fin 26 fitted to the top part 25 of the bottom 24 of the float tank bulges out so that its extension 27 passes a point B positioned midway between the center of floatation [a point of intersection of a draft line (still water surface) 28 and the center line 29 of the hull]F and the center of gravity G of the hull. The edge 26' of the anti-rolling fin 26 Is positioned on a vertical extension 31 from the side surface 30 of the float tank so as not to be damaged when the boat comes alongside a pier. An angle $\theta$ of inclination of the outer side of the bottom 24 of the float tank 12 is set at 5° to 30°.

It is important that most part of the aforesaid anti-rolling fin 26 projects outside of a straight line 42 connecting the outer end part M of the bottom of the float tank 12 and the outer end part N of the bottom of the main hull 11. Inside this straight line 42, seawater in this area moves together with the hull 10 when the hull rolls, and therefore the anti-rolling fin 26 does not function nearly at all even if it is fitted in this area.

Figure 4:
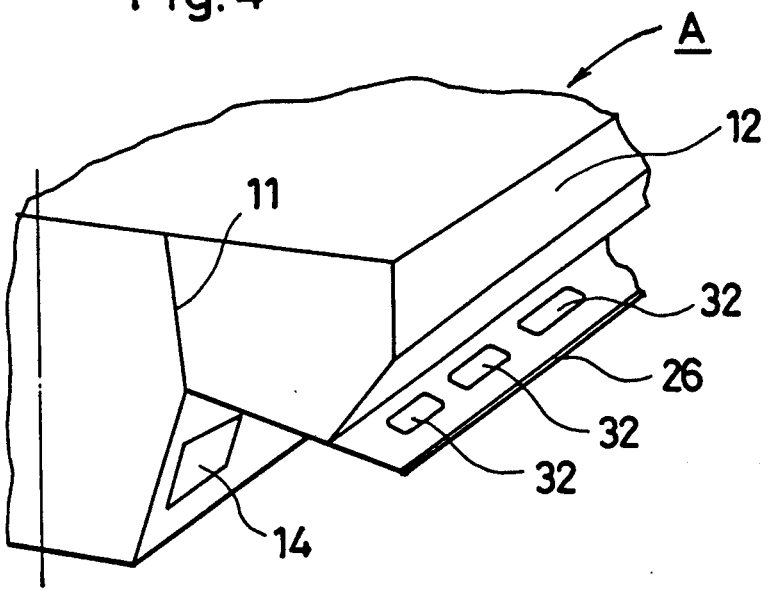
FIG. 4 is a perspective view of another example of an anti-rolling fin.

When a plurality of openings 32 are provided in the anti-rolling fin 26 as shown in FIG. 4, an effect of anti-rolling can be expected from an eddy resistance which is generated when a vortex occurs in the opening 32 at the time of rolling of the hull.

In order to protect the aforesaid main hull and the observation windows 14, bumpers 33 are fitted to the lower parts of the lateral sides of the main hull 11. Each of these bumpers 33 is constructed of a slender tubular body 34 extending along the lateral side 13 of the main hull 11, tubular horizontal members 35 connecting the tubular body 34 and the main hull 11, and tubular slanting members 36 connecting also the tubular body 34 and the main hull 11. The edge of this bumper 33 projects a little outside of the upper end part of the observation window 14 so as to protect the main hull 11 and, particularly, the observation windows 14.

Figure 5:
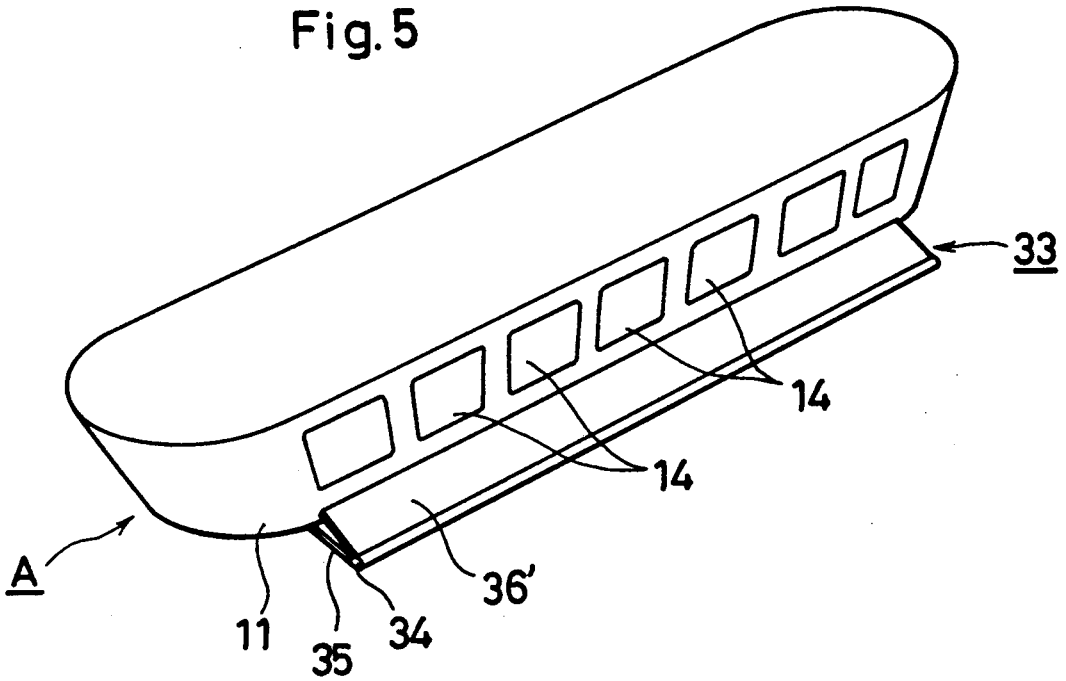
FIG. 5 is a perspective view of another example of a bumper.

As shown in FIG. 5, a plate-type slant member 36' may be used in place of the above tubular slanting member 36, and then the bumpers 33 can exhibit a function as a rolling prevention plate in addition to their function as the bumper. In this case as well, it is necessary, of course, for the bumper 33 to project outside of a straight line 42 connecting the outer end part M of the bottom of the float tank and the outer end part N of the bottom of the main hull together.

Combination of the anti-rolling fin 26 and the bumper 33 will be an effective way to decrease the rolling.

In engine rooms 37 of the float tanks 12 on the right and left sides, as shown in FIG. 3, engines 38 for rotating screws 39 are installed respectively. In the rear of the screws 39, rudders are disposed as shown in FIG. 1.

Since the anti-rolling fins each projecting outside of the straight line connecting the outer end part of the bottom of the float tank and the outer end part of the bottom of the main hull are provided on the opposite sides of the hull formed of the main hull and the float tanks provided on the lateral sides of the upper part of said main hull, as described above, the rolling under sail and in stoppage are lessened, and thus the semi-submerged glass boat according to the present invention is improved to a large extent in terms of the comfortableness on board, compared with conventional semi-submerged glass boat. Since waves flow along the bottom surfaces of the V-shaped float tanks, in addition, the shock due to the waves is lessened, compared with conventional float tanks having flat bottoms, and consequently the feeling of discomfort is reduced.

Effects of the width of the anti-rolling fin, the place of installation and the angle of installation thereof for reducing the rolling of the semi-submerged glass boat were checked up.

(1) Model

Reduced scale: 1/10

L×B×d=1.143 m×0.4 m×0.12 m (2) Test facility

Water tank of a water depth of 2.15 m (3) Test item

Measurement was made on the free rolling of the semi-submerged glass boat.

(4) Test condition

Figure 6:
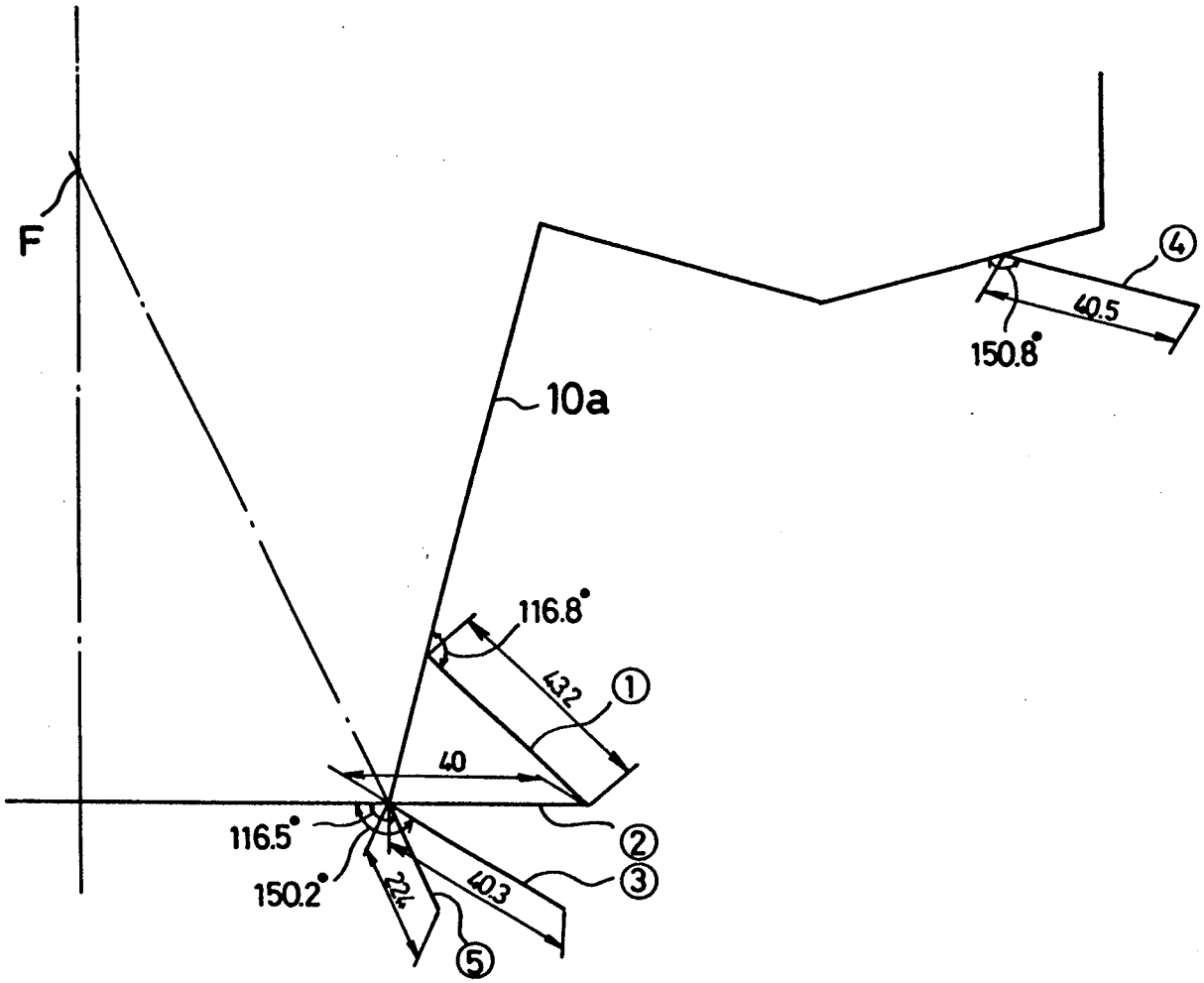
FIG. 6 is a sectional view showing an original ship form employed for a confirmation test, fitting positions of anti-rolling fins (1) to (5), etc.

Test conditions consisted of six conditions in total, an original ship form (without anti-rolling fins) 10a and ones provided with anti-rolling fins ① to ⑤ respectively, as shown in FIG. 6.

(5) Analysis method

For measurement, the free rolling was generated on the still water with an initial heel of 10° through 15° and the data obtained by two tests were averaged.

A rolling angle $\phi i$ at the time of synchronization is obtained generally by the following equation when a coefficient of rolling decrease ratio (N coefficient) is used.

$$\phi i = \sqrt{\pi\gamma\theta w/2N}$$

where $\gamma$ : a coefficient of effective wave angle $\theta$w: a maximum wave angle N : the coefficient of rolling decrease ratio (Bertan's N coefficient).

The relationship between an angle of rolling decrease $\Delta\phi$ and the N coefficient can be obtained by the following equation.

$$\Delta\phi = N\,(\phi'_n)^2$$

where $\Delta\phi$ : the angle of rolling decrease $\phi'_n$: an average of two adjacent amplitudes. $[\phi'_n=(\phi_n+\phi_{n+1})/2]$ Accordingly, the ratio between a rolling angle $\phi_o$ of the original ship form and the rolling angle $\phi i$ in the case when the anti-rolling fins are fitted is determined in the following equation by using the respective coefficients of rolling decrease ratios $N_o$ and Ni.

$$\phi i/\phi_o = \sqrt{N_o/Ni}$$

The N coefficient was determined by forming a curve of rolling decrease from wave profiles obtained from free motions and further by scaling the axes of abscissa in $(\phi'_n)^2$ for linear approximation.

(6) Result of analysis

The results of analysis for a rolling ratio, the coefficient of rolling decrease ratio and an inherent motion period are shown in the below Table 1. The Table 1 shows the results of analysis for a rolling angle $\phi_n$=6.75° (half of amplitude) or smaller.

(7) Summary

As for the ratio of rolling decrease obtained when the anti-rolling fins are fitted to the original ship form, the anti-rolling fins ④ are the most effective, and an effect of decrease of 43% was obtained in a motion test on the still water. Besides, an effect of decrease of 17% was obtained from the anti-rolling fins ③ an effect of 15% from the fins ⑤ and an effect of 11% from the fins ① As to the anti-rolling fins ② an effect of decrease of 4% was obtained therefrom.

TABLE 1

| | Rolling ratio $\Phi i/\Phi_o$ | Coefficient of rolling decrease ratio N | Inherent motion period $T\Phi$ (sec) | Ratio of rolling decrease % |
|---|---|---|---|---|
| Original | 1.00 | 0.0392 | 2.99 | 0 |
| Anti-rolling fin ① | 0.89 | 0.0493 | 3.12 | 11 |
| Anti-rolling fin ② | 0.96 | 0.0424 | 3.13 | 4 |
| Anti-rolling fin ③ | 0.83 | 0.0571 | 3.23 | 17 |
| Anti-rolling fin ④ | 0.57 | 0.1213 | 3.30 | 43 |
| Anti-rolling fin ⑤ | 0.85 | 0.0549 | 3.15 | 15 |

$\Phi i$ = 6.75° or smaller

What is claimed is:

1. A semi-submerged glass boat having a hull formed of a main hull having a center line, a center of gravity, a center of flotation, and float tanks provided on lateral sides of an upper part of said main hull, said main hull having observation windows provided on the lateral sides of a lower part thereof and anti-rolling fins secured to a bottom of each float tank, each anti-rolling fin projecting outside of a straight line connecting the outer end part of the bottom of the float tank and the outer end part of the bottom of the main hull, and projecting along a line from the center line of the main hull between the center of flotation and the center of gravity, and a bottom point on the float tank, an outermost edge of each said anti-rolling fin being within a vertical extension line of an outer side surface of the float tank.

2. A semi-submerged glass boat according to claim 1, wherein the aforesaid float tanks have bottoms formed substantially in the shape of V.

3. A semi-submerged glass boat according to claim 1, wherein the aforesaid main hull has bumpers for protecting the observation windows at least.

4. A semi-submerged glass boat according to claim 1, wherein said main hull has bumpers which are made of a plate for protecting the observation window and decreasing the rolling of the boat.

5. A semi-submerged glass boat according to claim 1, wherein the aforesaid main hull has an air space above the highest possible water line on said float tanks, leaving sufficient room for a person to breathe when the main hull is filled with water.

* * * * *